US007004435B2

(12) United States Patent
Formon

(10) Patent No.: US 7,004,435 B2
(45) Date of Patent: Feb. 28, 2006

(54) BRACKET FOR ABSORBENT SHEET PRODUCTS

(75) Inventor: John Formon, Appleton, WI (US)

(73) Assignee: SCA Tissue North America LLC, Neenah, WI (US)

( * ) Notice: Subject to any disclaimer, the term of this patent is extended or adjusted under 35 U.S.C. 154(b) by 0 days.

(21) Appl. No.: 10/787,584

(22) Filed: Feb. 27, 2004

(65) Prior Publication Data

US 2005/0189455 A1 Sep. 1, 2005

(51) Int. Cl.
*F16M 11/00* (2006.01)

(52) U.S. Cl. ..... 248/200; 248/300; 248/905; 206/233; 221/286

(58) Field of Classification Search ..... 248/200, 248/905, 205.3, 300, 311.2, 309.1, 318; 206/233; 221/283, 286, 303
See application file for complete search history.

(56) References Cited

U.S. PATENT DOCUMENTS 2,350,433 A * 6/1944 Vernon ..... 40/607.11
2,990,950 A * 7/1961 Alexander ..... 206/216
3,168,275 A * 2/1965 Grondin ..... 248/205.3
3,258,238 A * 6/1966 Grafton ..... 248/311.3
3,288,416 A * 11/1966 Franklin ..... 248/311.3
3,870,212 A * 3/1975 Polk ..... 225/42
4,175,673 A * 11/1979 McDonald et al. ..... 221/63
4,235,333 A 11/1980 Boone
4,250,601 A * 2/1981 Ward ..... 24/570
4,735,317 A * 4/1988 Sussman et al. ..... 206/449
5,516,000 A * 5/1996 Freiburger et al. ..... 221/48
6,354,462 B1 3/2002 Conran et al.
6,474,610 B1 * 11/2002 Hsieh ..... 248/309.1
6,572,063 B1 6/2003 Gitelman et al.

* cited by examiner

*Primary Examiner*—Amy J. Sterling
(74) *Attorney, Agent, or Firm*—Young & Thompson

(57) ABSTRACT

A bracket for supporting a container of absorbent sheet products includes first and second side walls each having a flange section perpendicular thereto for mounting to a substantially vertical mounting surface. A cross member extends between the first and second side walls as a front member. At least one bottom portion extends between the first and second side walls perpendicular to the cross member. The bottom portion is structured and arranged to be spaced apart from the mounting surface so that various containers of absorbent sheets can be arranged in the bracket to be dispensed from the top, bottom or front depending on the particular container.

20 Claims, 3 Drawing Sheets

BRACKET FOR ABSORBENT SHEET PRODUCTS

BACKGROUND OF THE INVENTION

1. Field of the Invention

The invention relates to a bracket, especially for supporting a container of absorbent or saturated sheet products.

2. Description of Related Art

Brackets are known that support various articles. In U.S. Pat. No. 6,572,063, a bracket is provided that supports a dental floss container. The bottom of the dental floss container rests on a solid bottom mount of the bracket, to dispense the dental floss in an upright position. The design of the bracket is such that a floss container slides snugly into the bracket.

U.S. Pat. No. 6,354,462 has a mounting bracket with a dispensing slot in the bottom mount to allow paper towels to be dispensed through the slot. This bracket is designed for use with a special housing that snaps into the bracket.

U.S. Pat. No. 4,235,333 describes a mounting bracket having a pair of tracks for sliding a container that holds a stack of sheet material thereon. The sheet material is then dispensed from the top of the container. This bracket is part of a complicated bathroom fixture that also includes a toilet roll dispenser.

The approach taken by the prior art in dispensing articles is to have a specially designed container that will only fit into the bracket in a single configuration. This approach requires a relatively complicated bracket and limits the size, shape and/or size of the container that can be held within the bracket.

SUMMARY OF THE INVENTION

It is therefore an object of the invention to overcome the disadvantages of the prior art, by providing a bracket that is relatively simple and is easy to manufacture, assemble and install.

It is another object of the invention to provide a bracket that can be used with a variety of different sized containers in a variety of different configurations.

According to the invention, a bracket for supporting a container of absorbent or saturated sheet products comprises first and second walls each having a flange section extending therefrom for mounting to a substantially vertical mounting surface, a cross member extending between the first and second walls, and at least one bottom portion extending between the first and second walls and perpendicular to the cross member. The bottom portion is structured and arranged to be spaced apart from the mounting surface.

The invention pertains to the bracket proper, i.e., with or without a container of absorbent sheet products contained therein.

The absorbent sheet product to be used in the container according to the invention is preferably, but not necessarily, a stack of interfolded paper napkins.

BRIEF DESCRIPTION OF THE DRAWINGS

Other objects, features and advantages of the invention will become more apparent after reading the following detailed description of the preferred embodiments of the invention, given with reference to the accompanying drawings, in which.

DETAILED DESCRIPTION OF THE PREFERRED EMBODIMENTS

Figure 1A:
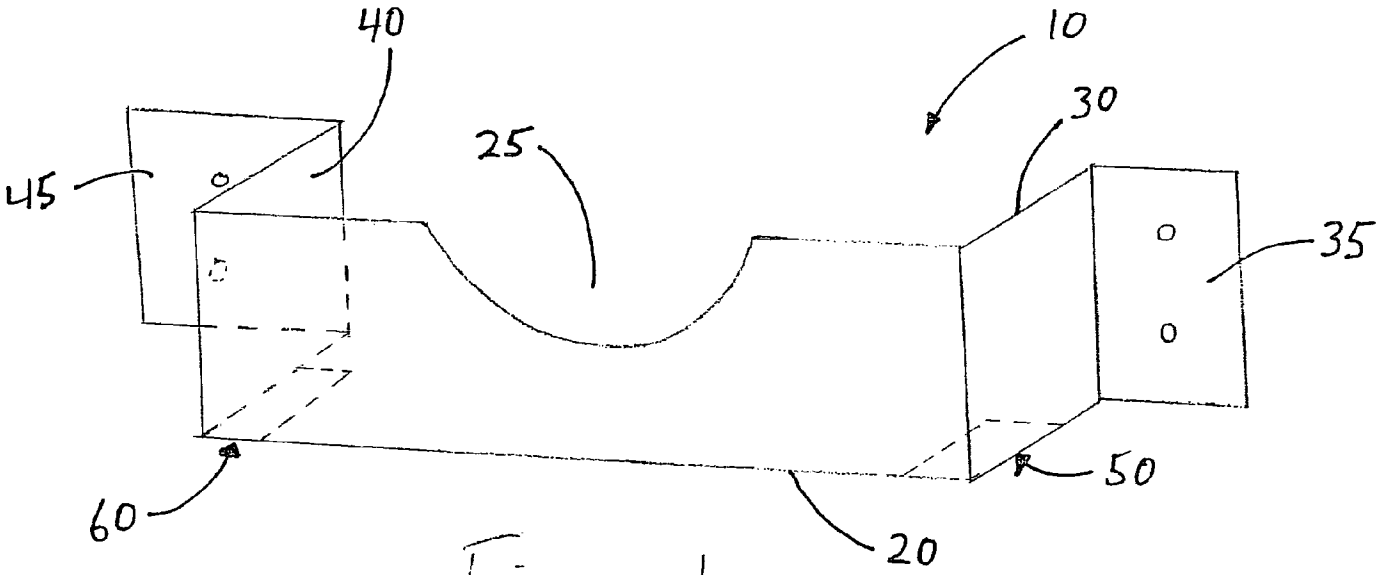
FIG. 1*a* is a perspective view of an embodiment of a bracket according to the present invention.
Figure 1B:
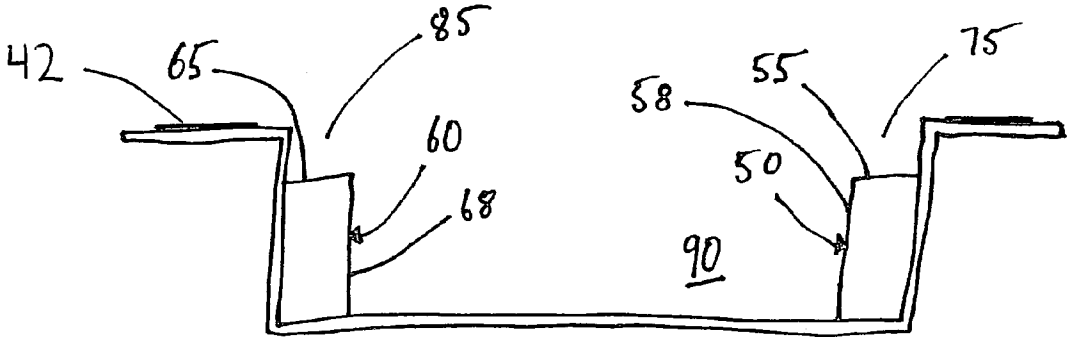
FIG. 1*b* is a top view of the bracket according to FIG. 1*a;*

FIGS. 1*a* and 1*b* show a bracket 10 according to an embodiment of the invention. The FIG. 1*a* embodiment is intended to support a container that dispenses wipers, but it will be appreciated that the bracket according to the invention could support substantially any rectangular shaped container, containing wipers, paper towels, tissues or other sheet products whether absorbent, or not, or other products such as safety spectacles or chewing gum contained within substantially rectangular containers.

The term "absorbent sheet products" as used herein embraces not only paper products such as paper napkins, but also absorbent nonwoven materials not normally classed as papers or tissues. Such nonwoven materials include pure nonwovens and hybrid nonwoven/pulp webs whose properties are similar to those of tissue paper, but which are based for example on nonwoven or airlaid materials containing low amounts of synthetic fibers, binders, wet strength agents and the like.

The members of the bracket 10 comprise a front piece or cross member 20, preferably having a substantially elongate rectangular configuration and optionally a cut out portion 25. The cross member 20 is between walls 30, 40 that form the sides of the bracket.

Each of the walls 30, 40 has a flange 35, 45 extending perpendicularly thereto for mounting to a substantially vertical surface, such as a wall of a room (not shown). In the preferred embodiment, the walls 30, 40 and flanges 35, 45 are perpendicular to each other. However, it is contemplated that the walls 30, 40 and even the crossmember 20 may not be straight and may even be curved to accommodate non-rectangular containers. In FIG. 1*a*, the flanges 35, 45 have mounting holes 36 and face away from the walls 30, 40 such that the flanges 35, 45 are outside a boundary defined by the walls 30, 40, the cross member 20 and the surface (not shown) to which the flanges 35, 45 would mount.

The bracket also includes at least one bottom portion (two bottom portions 50, 60 are shown in FIG. 1*b*). In the embodiment of FIG. 1*b*, the bottom portions 50, 60 extend from the walls 30, 40 such that there are gaps 75, 85 between ends 55, 65 of the bottom portions 50, 60 and the mounting surface (not shown) and also a space 90 between respective sides 58, 68 of the bottom portions 50, 60.

Figure 2:
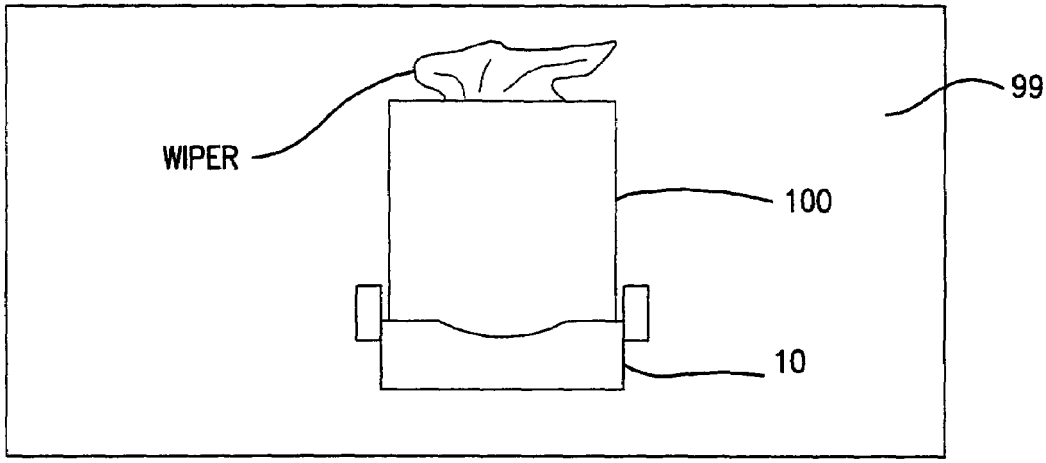
FIG. 2 is the bracket according to FIG. 1*a* mounted to a vertical surface and supporting a container of absorbent sheet to be dispensed from the top.
Figure 3:
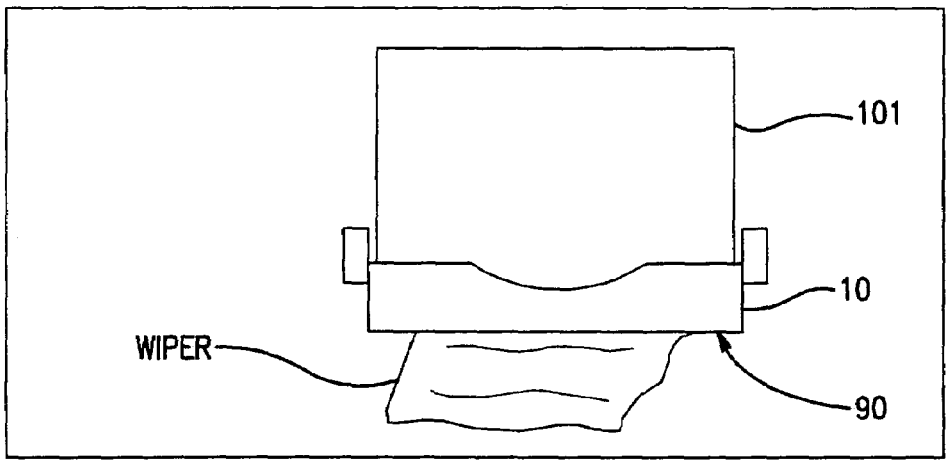
FIG. 3 is the bracket according to FIG. 1*a* mounted to a vertical surface and supporting a container of absorbent sheet to be dispensed from the bottom.
Figure 4:
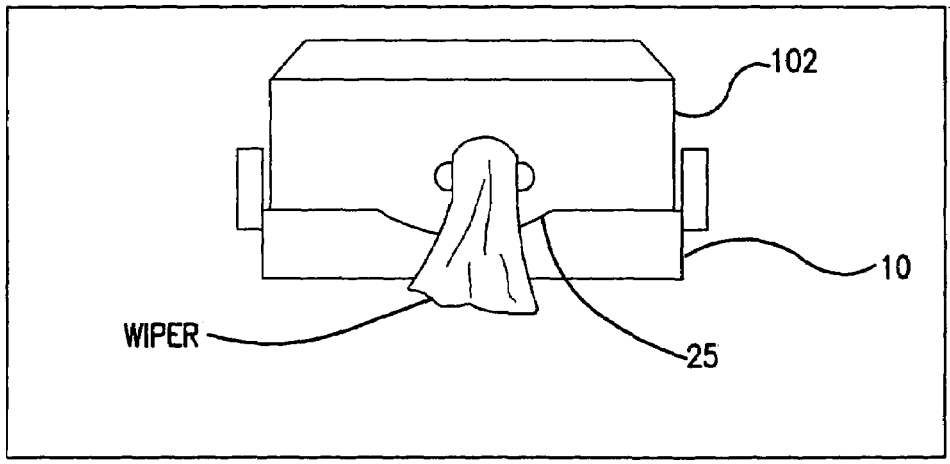
FIG. 4 is the bracket according to FIG. 1*a* mounted to a vertical surface and supporting a container of absorbent sheet to be dispensed from the front.

As seen in FIGS. 2–4, the above configuration of the mounting bracket 10 enables containers 100, 101, 102 having different dispensing capabilities to use the same mounting bracket 10. Specifically, as seen in FIG. 2, a container 100 with a top dispensing configuration can be placed in the bracket 10. FIG. 3 shows a bottom dispensing configuration with container 101 and FIG. 4 shows a front dispensing configuration with container 102. The space 90 allows the container 101 to dispense the product from the bottom as seen in FIG. 3, while the bottom portions 50, 60 provide support for the container 101. In addition, cut out 25 allows the container 102 to dispense the product from the front of the bracket 10 as seen in FIG. 4.

Figure 5:
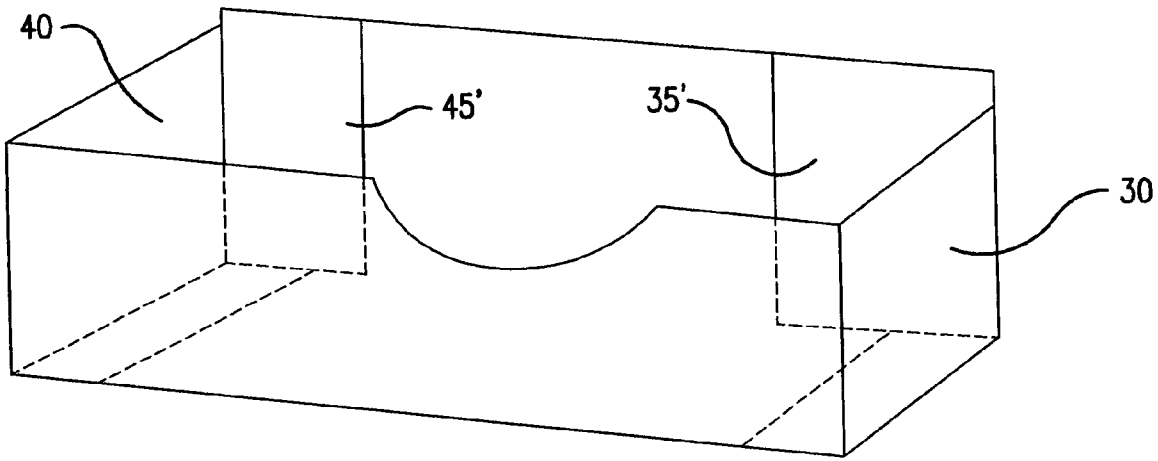
FIG. 5 is a perspective view of a second embodiment of a bracket according to the present invention.

In the embodiment of FIG. 5, the flange sections 35', 45' are facing inward such that each flange section 35', 45' is within a boundary defined by the walls 30, 40, the cross member 20 and the surface (wall 99 in FIG. 2, for example) to which the flanges 35', 45' would mount.

Figure 6:
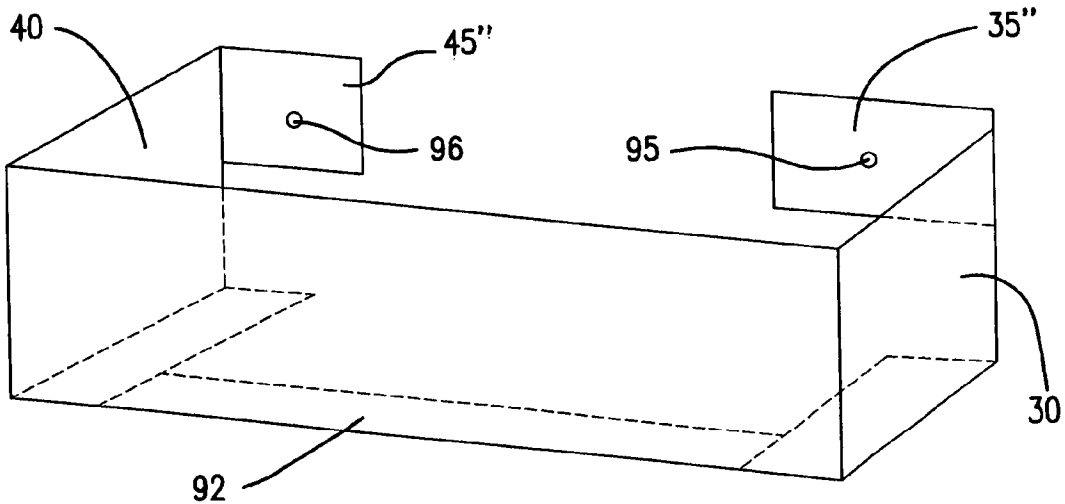
FIG. 6 is a perspective view of a third embodiment of a bracket according to the present invention.

In the embodiment of FIG. 1*a*, the flange sections 35, 45 have the same height as the walls 30, 40 and the cross member 20. However, as seen in FIGS. 5 and 6, the height of the flange sections may be different than that of the height of the walls 30, 40. Specifically, FIG. 5 shows the height of the flange sections 35', 45' is larger than the height of walls 30, 40. This may be advantageous when the medium connecting the flange sections to a vertical wall is an adhesive and the increased flange section surface area provides increased adhering strength.

FIG. 6 shows the flange section 35", 45" smaller that the walls 30, 40. Although FIG. 6 shows the flange sections 35", 45" aligned with the top of the walls 30, 40, one of ordinary skill in the art would readily understand that the flanges 35", 45" could be aligned with the bottom of the walls or any position in between.

As further seen in FIG. 6, through holes 95, 96 are formed in each of the flange sections 35", 45" to facilitate mounting the bracket 10 to a wall or other substantially vertical surface. Although one through hole is shown in each of the flange sections 35", 45" in FIG. 6 and two holes are shown in FIG. 1*a*, neither the number of through holes nor the specific placement of the through holes is of particular importance. In fact, As set forth above with respect to FIG. 5, the bracket 10 could be mounted to a wall using an adhesive without any through holes. Of course, other methods of mounting the bracket to the wall would be readily apparent to one of ordinary skill in the art.

The bracket 10 is readily manufactured and can be formed as an integral one-piece member. Specifically, one way of manufacturing the bracket is by starting from an elongate rectangular plastic blank. A central portion of the blank is cut out to form cut out 25. The blank is then folded to form walls 30, 40 and cross member 20. Walls 30, 40 are further folded to form the flanges 35, 45. Thereafter, the intersections of the cross member 20 and the walls 30, 40 and the intersections of the walls 30, 40 and the flanges 35, 45 are either notched or portions are removed and then are folded to form bottom portions 50, 60 (having portions removed) in FIG. 1*a*. Please note that FIG. 6 shows bottom front portion 92, while portion 92 is removed from both FIGS. 1*a* and 5.

Alternatively, the bracket could be molded as a single piece or could be formed as a plurality of pieces that are adhered or welded together, for example.

Accordingly, the bracket of the invention is a relatively simple device that is easy to manufacture. In addition, the bracket is readily mounted to a substantially vertical surface, such as a wall, using a fastener in the through holes or using an adhesive 42 that is either part of the bracket (for example an adhesive surface with a peel-back protective covering) or that is applied between the flange sections and the wall to mount the bracket.

The bracket is also a "universal" bracket in that various different containers can be mounted in different configurations in the same bracket in order to dispense from the top, bottom or front of the bracket.

While the present invention has been described in connection with various preferred embodiments thereof, it is to be understood that those embodiments are provided merely to illustrate the invention, and should not be used as a pretext to limit the scope of protection conferred by the true scope and spirit of the appended claims.

What is claimed is:

1. A bracket for supporting a container of absorbent or saturated sheet products, comprising:

first and second walls each having a flange section extending substantially perpendicular therefrom for mounting to a substantially vertical mounting surface;

a cross member extending between and connecting said first and second walls; and at least one bottom portion extending between said first and second walls and perpendicular to said cross member, and substantially perpendicular to said flange sections wherein the bottom portion isspaced apart from a mounting surface so as to define a lower opening permitting removal of sheet products from beneath said bracket, and wherein said cross member and said first and second walls define an upper opening that permits a box of sheet products to be placed through said upper opening.

2. The bracket as claimed in claim 1, wherein each said flange section is within a boundary defined by said first and second walls, said cross member and a mounting surface.

3. The bracket as claimed in claim 1, wherein each said flange section is outside a boundary defined by said first and second walls, said cross member and a mounting surface between said first and second walls.

4. The bracket as claimed in claim 1, wherein each said flange section has a same height as said first and second walls and said cross member.

5. The bracket as claimed in claim 1, wherein each said flange section has a different height than said first and second walls.

6. The bracket as claimed in claim 5, wherein said height of each said flange section is smaller than said first and second walls.

7. The bracket as claimed in claim 1, wherein said first and second walls, each said flange section, said bottom portion and said cross section are formed as an integral one-piece member.

8. The bracket as claimed in claim 1, wherein each said flange section comprises at least one through hole formed therein.

9. The bracket as claimed in claim 1, further comprising an adhesive connecting each said flange section to a mounting surface.

10. The bracket as claimed in claim 1 in combination with a container of absorbent sheet products.

11. The bracket as claimed in claim 1, wherein said cross member has a shallow U-shaped cut out.

12. A bracket for supporting a container of absorbent or saturated sheet products, comprising:

first and second walls each having a flange section substantially perpendicular thereto at a respective first end for mounting to a substantially vertical mounting surface;

a substantially rectangular cross member opposing a mounting surface and extending between and connected to said first and second walls at a respective second end; and a bottom member having a first portion extending substantially perpendicularly from said first wall, and a second portion extending substantially perpendicularly from said second wall, said first and second portions defining a first gap between each other and a second gap between said cross member and a mounting surface.

13. The bracket as claimed in claim 12, wherein each said flange section has at least one through hole formed therein.

14. The bracket as claimed in claim 12, further comprising an adhesive pad on a surface of each said flange section facing a mounting surface.

15. The bracket as claimed in claim 12, wherein said cross member has a shallow U-shaped cut out.

16. The bracket as claimed in claim 12, further comprising a bottom member third portion, such that said first portion, said second portion and said third portion form a substantially U-shaped bottom with the third portion between the first and second portions.

17. The bracket as claimed in claim 12 in combination with a container of absorbent sheet products.

18. A bracket for supporting a container of absorbent or saturated sheet products on a mounting surface, comprising:

a cross member opposing a mounting surface;

first and second walls extending from and connected to respective ends of said cross member and connectable to a mounting surface; and at least two bottom portions extending between and substantially perpendicular to said first and second walls and substantially perpendicular to said cross member, wherein said at least two bottom portions define a space between each other.

19. The bracket as claimed in claim 18, wherein said cross member has a shallow U-shaped cut out, so that a sheet of absorbent product can be dispensed from above the bracket when a container of absorbent sheet products held by the bracket is upright, and can be dispensed from below the bracket through said space when the container is upside-down, and can be dispensed through said U-shaped cut out when a dispensing portion of the container is facing a front of the bracket.

20. The bracket as claimed in claim 18, wherein each said first and second walls further comprise a flange for connecting said bracket to a mounting surface.

* * * * *